US006863230B2

(12) United States Patent
Palestrant

(10) Patent No.: US 6,863,230 B2
(45) Date of Patent: Mar. 8, 2005

(54) ATOMIZING NOZZLE AND METHOD FOR MANUFACTURE THEREOF

(76) Inventor: Nathan Palestrant, 5120 N. 79th Pl., Scottsdale, AZ (US) 85250

( * ) Notice: Subject to any disclaimer, the term of this patent is extended or adjusted under 35 U.S.C. 154(b) by 0 days.

(21) Appl. No.: 10/294,342

(22) Filed: Nov. 12, 2002

(65) Prior Publication Data

US 2004/0089744 A1 May 13, 2004

(51) Int. Cl.[7] ..... B05B 1/34

(52) U.S. Cl. ..... 239/469; 239/472; 239/474; 239/382; 239/383; 239/589.1

(58) Field of Search ..... 239/380–383, 239/463–488, 589–591, 7, DIG. 19, 333

(56) References Cited

U.S. PATENT DOCUMENTS

| | | | | |
|---|---|---|---|---|
| 3,672,578 A | * | 6/1972 | Wayne | 239/590 |
| 4,721,250 A | * | 1/1988 | Kennedy et al. | 239/383 |
| 5,154,356 A | * | 10/1992 | Sorenson | 239/550 |
| 5,740,970 A | | 4/1998 | Edwards | 239/551 |
| 5,769,325 A | * | 6/1998 | Jouillat et al. | 239/337 |
| 5,921,468 A | | 7/1999 | Palestrant | 239/383 |
| 5,927,611 A | | 7/1999 | Palestrant | 239/380 |
| 6,045,058 A | | 4/2000 | Döbbeling et al. | 239/11 |
| 6,065,689 A | | 5/2000 | Kizer et al. | 239/126 |
| 6,419,167 B1 | * | 7/2002 | Fuchs | 239/323 |

* cited by examiner

*Primary Examiner*—Thomas Denion
*Assistant Examiner*—Kyle M. Riddle
(74) *Attorney, Agent, or Firm*—Jordan M. Meschkow; Lowell W. Gresham; Meschkow & Gresham, P.L.C.

(57) ABSTRACT

An atomizing nozzle (20) for use in a misting system and a process (200) for manufacturing the atomizing nozzle (20) are provided. The atomizing nozzle (20) is made up of a nozzle body (24), a metallic orifice insert (26), and a non-metallic impeller. The nozzle body (24) has an inlet end (30), has an outlet end (32), has an insert recess (36) proximate the outlet end (32), and encompasses a first chamber (42). The metallic orifice insert (26) is affixed to the nozzle body (24) within the insert recess (36) and encompasses a second chamber (66). The non-metallic impeller (28) is configured to reside within the first and second chambers (42,66) between the metallic orifice insert (26) and the nozzle inlet end (30).

20 Claims, 7 Drawing Sheets

230

ATOMIZING NOZZLE AND METHOD FOR MANUFACTURE THEREOF

TECHNICAL FIELD OF THE INVENTION

The present invention relates generally to mist heads, which atomize pressurized fluid. Specifically, the present invention relates to atomizing nozzles that are configured to consistently produce a uniform fine mist.

BACKGROUND OF THE INVENTION

Atomizing nozzles, also called mist heads, are used in connection with misting systems to produce a fog or fine mist. A fluid, typically water, is forced under pressure through the atomizing nozzles to produce the mist. Desirably, the mist is sufficiently fine so that it rapidly evaporates. As the mist evaporates, the general area around the atomizing nozzles becomes cooler. Rapid evaporation prevents people and property located in the mist from getting wet and enhances the cooling effect. Accordingly, misting systems are often used for cooling and for increasing humidity.

In order to produce a fog or fine mist that quickly evaporates, atomizing nozzles conventionally include a metallic portion containing a small outlet orifice through which the fluid passes under pressure to produce the desired fog or mist. In addition, a metallic impeller, also called a plunger or poppet, is positioned within a passage that connects to the orifice. The action of the impeller within the passage fractures the fluid and produces a finer fog or mist.

The mist-producing orifice is either formed directly in the body of the atomizing nozzle or in an orifice insert pressed into a recess within the nozzle body. When the orifice is formed in an insert, the insert is typically pressed into place in the nozzle body with great force. This produces a fluid-tight seal even when the fluid is under high pressure. Since the insert is pressed into the nozzle body with great force, it cannot thereafter be removed for subsequent cleaning of the orifice to remove the deposited mineral materials.

In time, these deposited mineral materials will eventually completely block passage of the fluid, and the nozzle is no longer able to produce the fog or mist. Accordingly, conventional atomizing nozzles are expensive to acquire and become clogged during use. Such blocked nozzles cannot be unclogged, necessitating the purchase and installation of replacement nozzles.

SUMMARY OF THE INVENTION

Accordingly, it is an advantage of the present invention that an improved atomizing nozzle and method for manufacture thereof are provided.

Another advantage of the present invention is that an atomizing nozzle is provided that has a metallic orifice insert and a non-metallic impeller.

Another advantage of the present invention is that an atomizing nozzle is provided that resists the rapid build-up of residual mineral materials contained in the fluid.

The above and other advantages of the present invention are carried out in one form by an atomizing nozzle for use in a misting system. The atomizing nozzle includes a nozzle body having a nozzle inlet end, having a nozzle outlet end, and encompassing a fluid chamber between the nozzle inlet and outlet ends, a metallic orifice insert affixed to the nozzle body proximate the nozzle outlet end, and a non-metallic impeller configured to reside within the fluid chamber between the metallic orifice insert and the nozzle inlet end.

The above and other advantages of the present invention are carried out in another form by a method of manufacturing an atomizing nozzle for use in a misting system. The method incorporates fabricating a nozzle body encompassing a fluid chamber, fabricating a metallic orifice insert, fabricating a non-metallic impeller, inserting the non-metallic impeller into the fluid chamber, and affixing the metallic orifice insert into the nozzle body.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
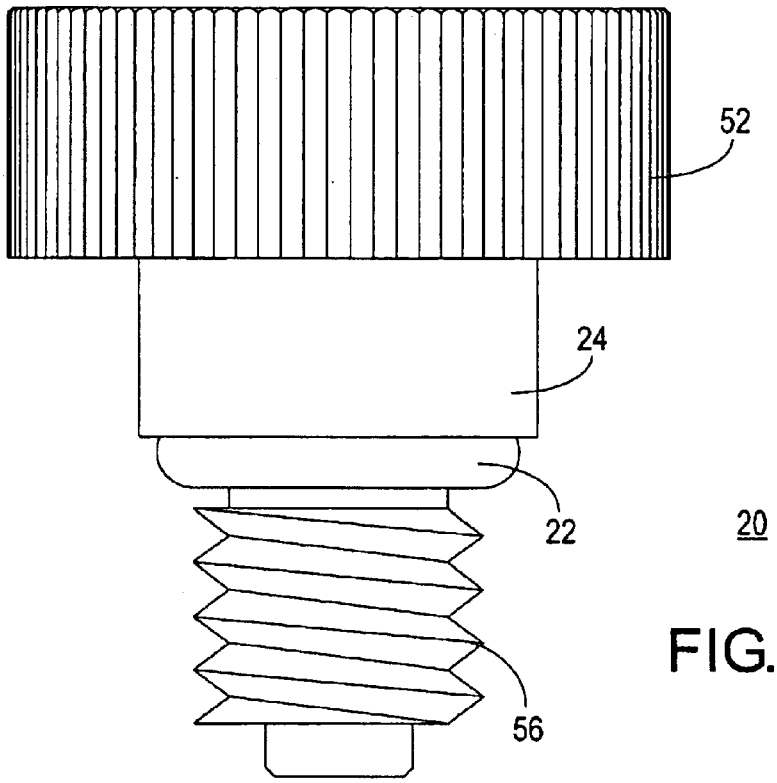
FIG. 1 shows a front view of an atomizing nozzle in accordance with a preferred embodiment of the present invention.
Figure 2:
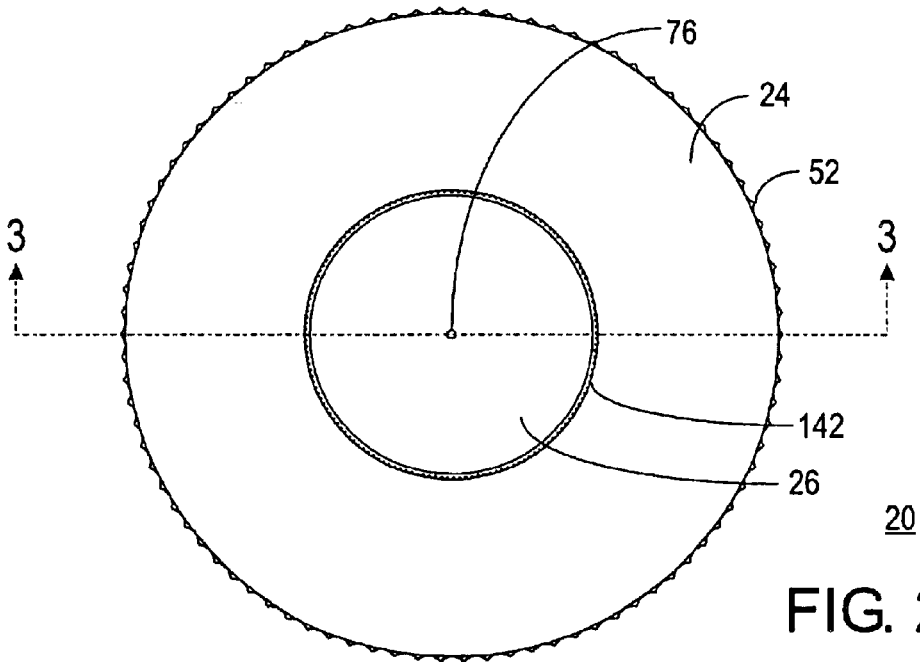
FIG. 2 shows a top view of the atomizing nozzle of FIG. 1 in accordance with a preferred embodiment of the present invention.
Figure 3:
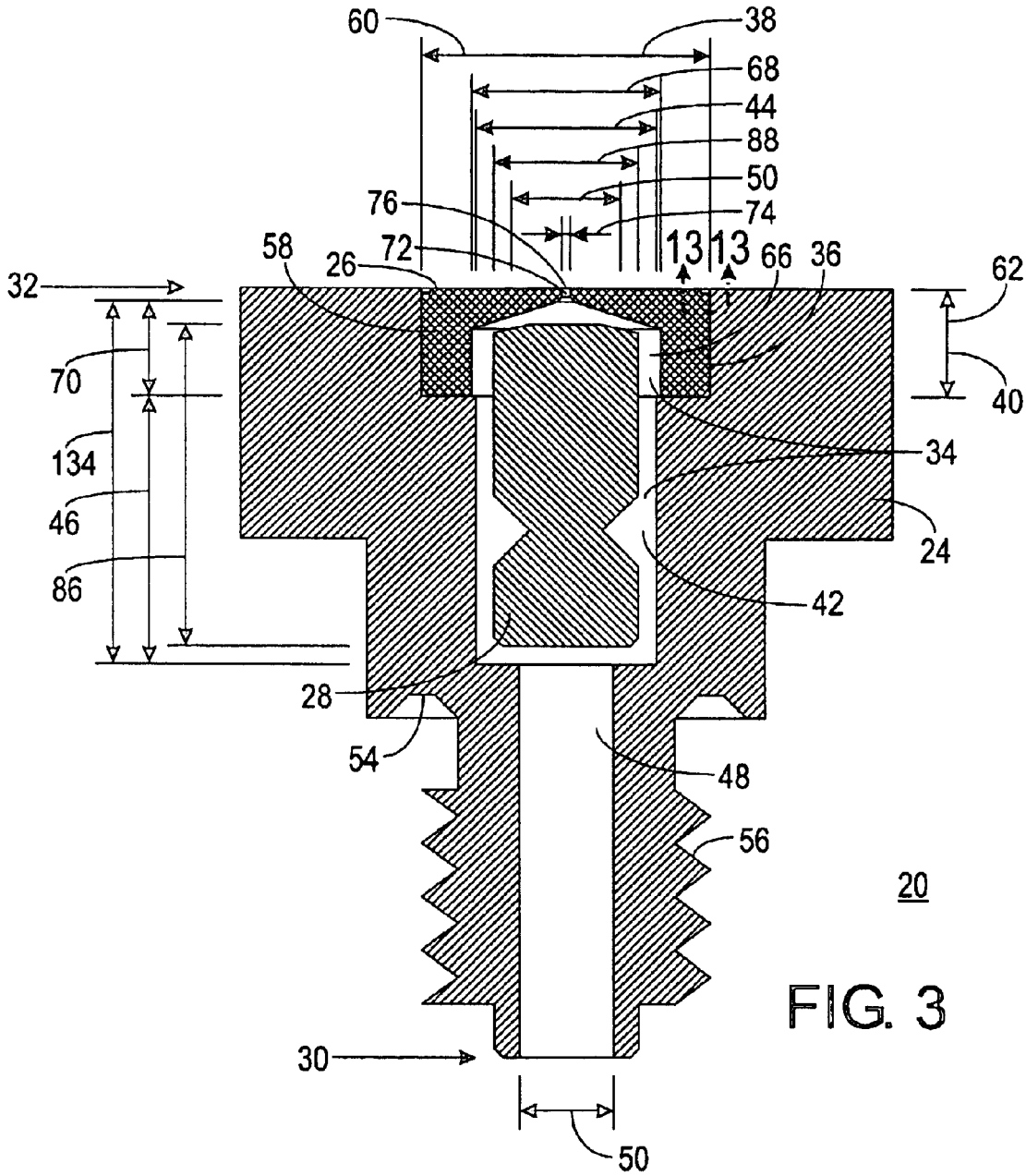
FIG. 3 shows a cross-sectional front view taken at line 3—3 of FIG. 2 of the atomizing nozzle of FIG. 1 with O-ring removed in accordance with a preferred embodiment of the present invention.
Figure 4:
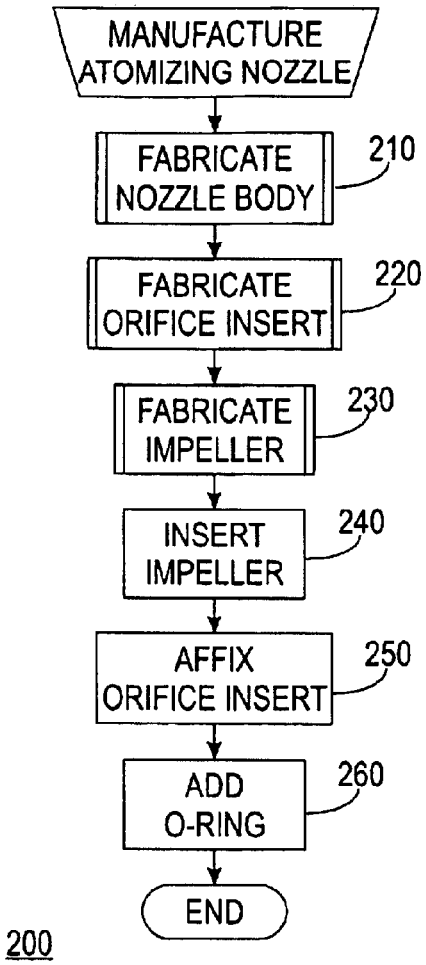
FIG. 4 shows a flow chart of a process to manufacture the atomizing nozzle of FIG. 1 in accordance with a preferred embodiment of the present invention.

FIG. 1 shows a front view and FIG. 2 shows a top view of an atomizing nozzle 20 in accordance with a preferred embodiment of the present invention. FIG. 3 shows a cross-sectional front view, taken at line 3—3 of FIG. 2, depicting atomizing nozzle 20 with O-ring 22 removed for clarity. FIG. 4 shows a flow chart of a process 200 to manufacture atomizing nozzle 20 in accordance with a preferred embodiment of the present invention. The following discussion refers to FIGS. 1, 2, 3, and 4.

Atomizing nozzle 20 is configured for attachment to a pipe (not shown) in a misting system (not shown), thereby providing a fog or mist for cooling and/or hydrating. Atomizing nozzle 20 is made up of a nozzle body 24, an orifice insert 26, an impeller 28 (also known as a plunger or poppet), and O-ring 22. Nozzle body 24 has an inlet end 30 and an outlet end 32. Nozzle body 24 also encompasses a fluid chamber 34 between inlet end 30 and outlet end 32. Orifice insert 26 is affixed to nozzle body 24 proximate outlet end 32. Impeller 28 resides within fluid chamber 34 of nozzle body 24.

The components of nozzle body 24 are fabricated and integrated by subprocesses within process 200. These subprocesses are discusses hereinafter and depicted in FIGS. 5, 6, and 7.

Figure 5:
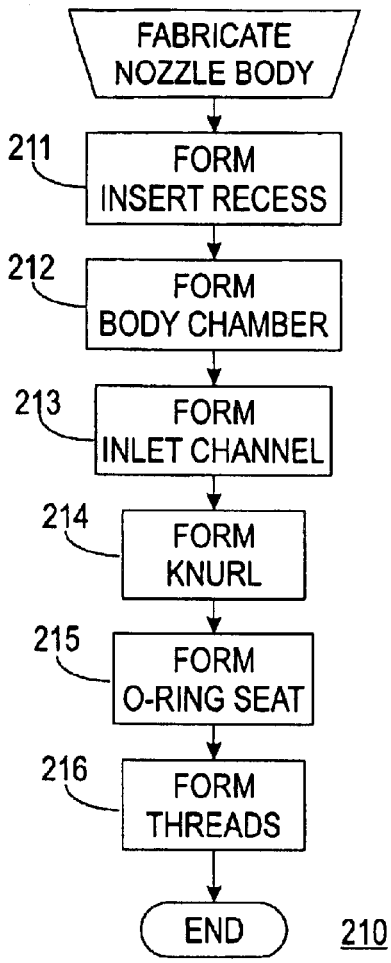
FIG. 5 shows a flowchart of a subprocess to fabricate a nozzle body for the atomizing nozzle of FIG. 1 in accordance with a preferred embodiment of the present invention.

FIG. 5 shows a flowchart of a subprocess 210 to fabricate nozzle body 24 for atomizing nozzle 20 in accordance with a preferred embodiment of the present invention. The following discussion refers to FIGS. 1, 2, 3, 4, and 5.

Nozzle body 24 is fabricated by subprocess 210 of process 200. Subprocess 210 contains tasks 211, 212, 213, 214, 215, and 216 to form various features of nozzle body 24.

In task 211, subprocess 210 forms an insert recess 36 in nozzle body 24 proximate inlet end 32. In the preferred embodiment, insert recess 36 is formed as substantially a right-cylindrical opening extending into nozzle body 24 from outlet end 32. Insert recess 36 has a recess diameter 38 and a recess length 40. Insert recess 36 is configured to contain orifice insert 26.

In task 212, subprocess 210 forms a body chamber 42. Body chamber 42 is formed as substantially a right-cylindrical opening extending into nozzle body 24 from insert recess 36. Body chamber 42 has a body-chamber diameter 44 and a body-chamber length 46. It will be appreciated that other shapes may be used for body chamber 42. The use of another shape does not depart from the spirit of the present invention.

In task 213, subprocess 210 forms a fluid inlet channel 48. Inlet channel 48 is formed substantially as a right-cylindrical opening extending through nozzle body 24 from body chamber 42 to inlet end 30. Inlet channel 48 has an inlet-channel diameter 50. It will be appreciated that other shapes may be used for fluid inlet channel 48. The use of another shape does not depart from the spirit of the present invention.

In task 214, subprocess 210 forms a knurl 52 around an outside of nozzle body 24. Knurl 52 serves to allow atomization nozzle 20 to be attached to and detached from a pipe (not shown) by hand. It will be appreciated that other methods of attachment and detachment may be possible or desirable. In this case, task 214 may form the desired shape or texture (e.g., a hexagonal shape) without departing from the spirit of the present invention.

In task 215, subprocess 210 forms a seat 54 for O-ring 22. O-ring seat 54 is depicted in FIG. 3, from which Figure O-ring 22 has been removed for clarity. O-ring 22 is depicted in FIG. 1, and is depicted seated in O-ring seat 54 in FIG. 15 (discussed hereinafter).

And in task 216, subprocess 210 forms threads 56. Threads 56 serve to attach atomizing nozzle 20 to a pipe (not shown) of a misting system (not shown). It will be appreciated that other methods of attachment may be possible or desirable. In this case, task 214 may form the desired attachment means (e.g., a crimp fitting) without departing from the spirit of the present invention.

In the preferred embodiment, the misting system (not shown) is a high-pressure water-based misting system. Nozzle body 24 is therefore desirably fabricated of a stable metal, such as brass, suitable for use with such a misting system. Those skilled in the art will appreciate that, depending upon the use for which the misting system is intended, other materials may be desirable.

Depending upon the material of which nozzle body 24 is to be fabricated, subprocess 210 may involve molding, machining, or otherwise producing the features formed by tasks 211, 212, 213, 214, 215, and 216 using established techniques. It will also be appreciated that the order of tasks 211, 212, 213, 214, and 216 within subprocess 210 is irrelevant to this discussion. For example, tasks 211, 212, 213, 214, 215, and 216 may be performed substantially simultaneously if subprocess 210 fabricates nozzle body 24 by molding.

Figure 6:
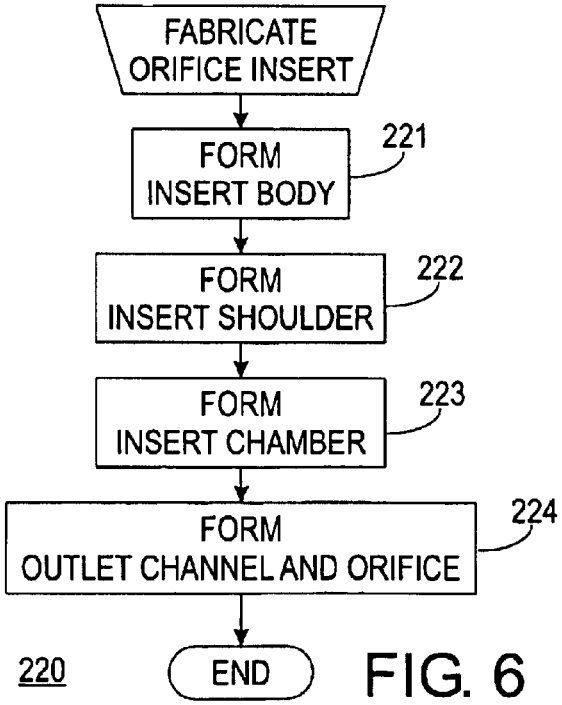
FIG. 6 shows a flowchart of a subprocess to fabricate an orifice insert for the atomizing nozzle of FIG. 1 in accordance with a preferred embodiment of the present invention.

FIG. 6 shows a flowchart of a subprocess 220 to fabricate orifice insert 26 for atomizing nozzle 20 in accordance with a preferred embodiment of the present invention. The following discussion refers to FIGS. 2, 3, 4, and 6.

Orifice insert 26 is fabricated by subprocess 220 of process 200. Subprocess 220 contains tasks 221, 222, 223, and 224 to form various features of orifice insert 26.

In task 221, subprocess 220 forms a body 58 of orifice insert 26. Desirably, insert body 58 takes the form of a right-cylindrical plug having an insert diameter 60 and an insert length 62. Desirably, insert diameter and length 60 and 62 are substantially equal to recess diameter and length 38 and 40, respectively.

In task 222, subprocess 220 forms a shoulder 64 around insert 26. Insert shoulder 64 is used to affix orifice insert 26 to nozzle body 24 in the preferred embodiment, as discussed hereinafter. It will be appreciated, however, that other means of affixing orifice insert 26 to nozzle body 24 are possible that do not require insert shoulder 64, or where insert shoulder 64 may be contra-indicated. The use of one of these other means of affixing orifice insert 26 to nozzle body 24 may eliminate task 222. The elimination of task 222 does not depart from the spirit of the present invention.

In task 223, subprocess 220 forms a chamber 66 within insert 26. Insert chamber 66 is formed as substantially a right cylinder having an insert-chamber diameter 68 and an insert-chamber length 70. It will be appreciated, however, that other shapes may be used for insert chamber 66. The use of another shape does not depart from the spirit of the present invention.

In task 224, subprocess 220 forms an outlet channel 72 through insert 26. Outlet channel 72 has an outlet-channel diameter 74. An outside end of outlet channel 72 (i.e., the end opposite insert chamber 66) forms an orifice 76.

It will be appreciated that outlet channel 72 and orifice 76 are exaggerated in the Figures for clarity. Desirably, outlet-channel diameter 74 is miniscule in size to more readily produce a fine mist or fog.

Orifice insert 26 is a metallic orifice insert. That is, orifice insert 26 is fabricated of metal. Desirably, orifice insert 26 is fabricated of a metal or an alloy of metals that is substantially non-reactive to air or water (or other fluid to be atomized by atomizing nozzle 20). By being substantially non-reactive, corrosion is kept to a minimum, and the useful lifetime of atomizing nozzle 20 is maximized. Desirably, orifice insert 26 is fabricated of a metal harder than the material of which nozzle body 24 is fabricated. In the preferred embodiment, nozzle body 24 is fabricated of brass and orifice insert 26 is fabricated of stainless steel. Those skilled in the art will appreciate that orifice insert may be fabricated of other materials, e.g., alloys of aluminum, titanium, and magnesium, without departing from the spirit of the present invention.

Those skilled in the art will appreciate that subprocess 220 may involve machining or otherwise producing the features formed by tasks 221, 222, 223, and 224 using established techniques. It will also be appreciated that the order of tasks 221, 222, 223, and 224 within subprocess 220 is irrelevant to this discussion.

Figure 7:
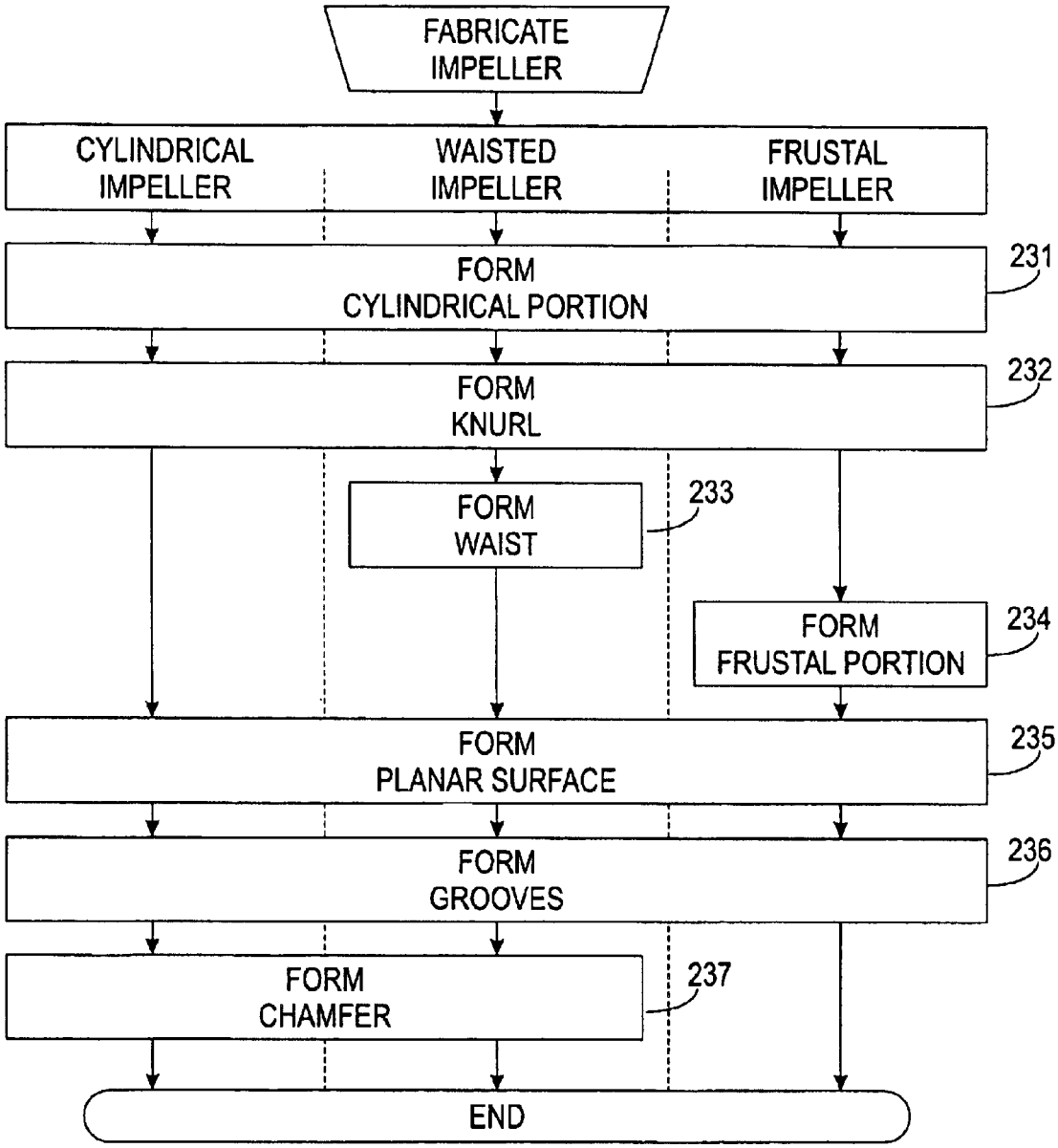
FIG. 7 shows a flowchart of a subprocess to fabricate an impeller for the atomizing nozzle of FIG. 1 in accordance with a preferred embodiment of the present invention.
Figure 8:
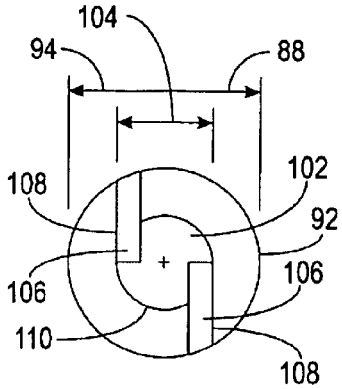
FIG. 8 shows a top view of an impeller in accordance with a preferred embodiment of the present invention.
Figure 9:
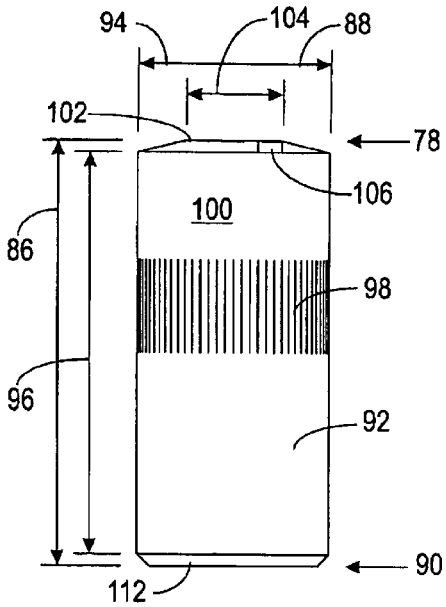
FIG. 9 shows a front view of a cylindrical impeller in accordance with a preferred embodiment of the present invention.
Figure 10:
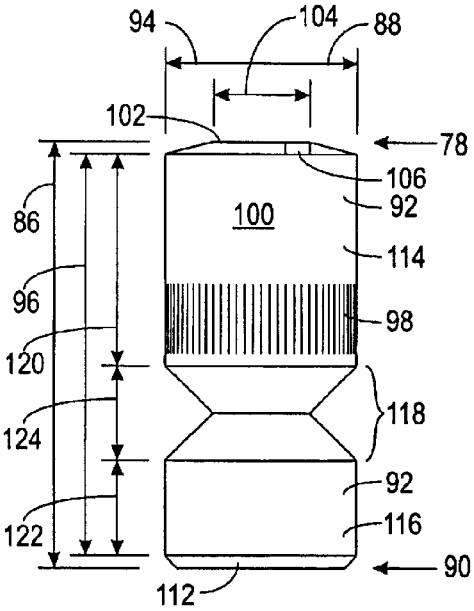
FIG. 10 shows a front view of a waisted impeller in accordance with a preferred embodiment of the present invention.
Figure 11:
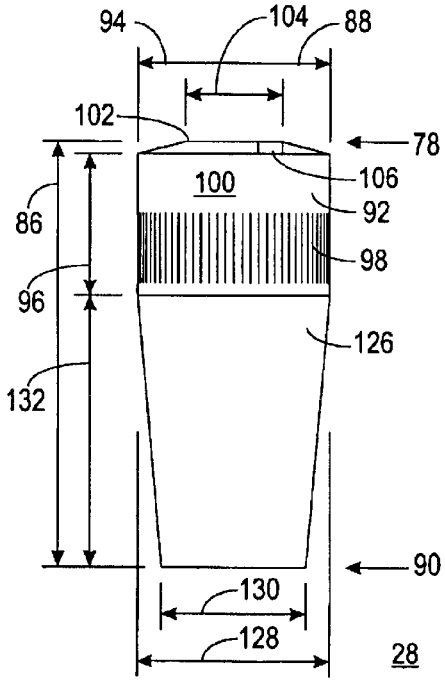
FIG. 11 shows a front view of a frustal impeller in accordance with a preferred embodiment of the present invention.

FIG. 7 shows a flowchart of a subprocess 230 to fabricate impeller 28 for atomizing nozzle 20 in accordance with a preferred embodiment of the present invention. Impeller 28 may be realized in any of a plurality of forms, three of which are exemplified in the Figures. FIG. 8 shows a top view of impeller 28 depicting an impeller outlet end 78 common to all forms, and FIGS. 9, 10, and 11 show a front views of impeller 28 realized as a cylindrical impeller 80 (FIG. 9), a waisted impeller 82 (FIG. 10), and a frustal impeller 84 (FIG. 11) in accordance with preferred embodiments of the present invention. The following discussion refers to FIGS. 3, 4, 7, 8, and 9.

Impeller 28 is fabricated by subprocess 230 of process 200. Subprocess 230 is made up of tasks 231, 232, 233, 234, 235, 236, and 237. Subprocess 230 may fabricate impeller 28 to be realized in any of a plurality of desired forms. All of tasks 231, 232, 233, 234, 235, 236, and 237 may not be used for a given realization.

In one realization, subprocess 230 manufactures impeller 28 and cylindrical impeller 80. Subprocess 230 then contains tasks 231, 232, 235, 236, and 237 to form various features of cylindrical impeller 80.

Cylindrical impeller 80 is a cylindroid having a length 86 and a diameter 88. Cylindrical impeller 80 has an outlet end 78, an inlet end 90, and a cylindrical portion 92 between outlet and inlet ends 78 and 90.

In task 231, subprocess 230 forms a substantially cylindrical portion 92 of impeller 28. Cylindrical portion 92 has a diameter 94 substantially equal to impeller diameter 88. Cylindrical portion 92 also has a length 96 that is less than impeller length 86.

In task 232, subprocess 230 forms a knurl 98 around an outside surface 100 of cylindrical portion 92. Impeller knurl 98 serves to fracture the water or other fluid during operation. Those skilled in the art will appreciate that knurl 98 is not a requirement of the present invention. The omission of task 232, and of knurl 98, does not depart from the spirit of the present invention.

In task 235, subprocess 230 forms a raised substantially circular planar surface 102 at impeller outlet end 78. Planar surface 102 has a diameter 104 less than that of impeller diameter 88.

In task 236, subprocess 230 forms grooves 106 at impeller outlet end 78. Grooves 106 have an outer edge 108, which is substantially tangential to a circumference 110 of planar surface 102. Grooves 106 serve to further fracture the water or other fluid during operation.

And in task 237, subprocess 230 forms a chamfer 112 at impeller inlet end 90. Chamfer 112 aids in the insertion of impeller 28 into nozzle body 24. Those skilled in the art will appreciate that knurl 112 is not a requirement of the present invention. The omission of task 237, and of chamfer 112, does not depart from the spirit of the present invention.

The following discussion refers to FIGS. 3, 4, 7, 8, and 10.

In another realization, subprocess 230 manufactures impeller 28 as waisted impeller 82. Subprocess 230 then contains tasks 231, 232, 233, 235, 236, and 237 to form various features of waisted impeller 82.

Waisted impeller 82 is a cylindroid having a length 86 and a diameter 88. Waisted impeller 82 has an outlet end 78, an inlet end 90, and a cylindrical portion 92 between outlet and inlet ends 78 and 90. Cylindrical portion 92 is divided into a first cylindrical portion 114 and a second cylindrical portion 116 by a waist 118.

In task 231, subprocess 230 forms substantially cylindrical portion 92 of impeller 28 as discussed hereinbefore. Cylindrical-portion diameter 94 is substantially equal to impeller diameter 88. Cylindrical-portion length 96 is less than impeller length 86.

In task 232, subprocess 230 forms knurl 98 around outside surface 100 of cylindrical portion 92 as discussed hereinbefore.

In task 233, subprocess 230 forms waist 118 in cylindrical portion 92. Waist 118 divides cylindrical portion 92 into first cylindrical portion 114 having a first cylindrical-portion length 120, and second cylindrical portion 116 having a second cylindrical-portion length 122. Waist 118 has a length 124 such that the sum of first cylindrical-portion length 120 plus waist length 124 plus second cylindrical-portion length 122 is substantially equal to the original (pre-task 233) cylindrical-portion length 96 and less than impeller length 86. Waist 118 serves to generate turbulence and aids in the fracturing of the water or other fluid during operation.

Tasks 235, 236, and 237 of subprocess 230 form raised substantially circular planar surface 102, grooves 106, and chamfer 112 as discussed hereinbefore.

The following discussion refers to FIGS. 3, 4, 7, 8, and 11.

In yet another realization, subprocess 230 manufactures impeller 28 as frustal impeller 84. Subprocess 230 then contains tasks 231, 232, 234, 235, and 236 to form various features of frustal impeller 84.

Frustal impeller 84 is a cylindroid having a length 86 and a diameter 88. Frustal impeller 82 has an outlet end 78, an inlet end 90, a cylindrical portion 92 between outlet and inlet ends 78 and 90, and a frustal portion 126 between cylindrical portion 92 and inlet end 90.

In task 231, subprocess 230 forms substantially cylindrical portion 92 of impeller 28. Cylindrical-portion diameter 94 is substantially equal to impeller diameter 88. Cylindrical-portion length 96 is less than one-half of impeller length 86.

In task 232, subprocess 230 forms knurl 98 around outside surface 100 of cylindrical portion 92 as discussed hereinbefore.

In task 234, subprocess 230 forms a frustal portion 126 of impeller 28. Frustal portion 126 is formed as a right frustum having a major diameter 128 substantially equal to cylindrical-portion diameter 94, and a minor diameter 130 less than major diameter 128. A major-diameter end of frustal portion 126 is contiguous with cylindrical portion 92. Frustal portion 126 has a length 132 greater than cylindrical-portion length 96 such that a sum of cylindrical-portion length 96 and frustal-portion length 132 is less than impeller length 86. Frustal portion 126 causes compression and acceleration of the water or other fluid during operation. This serves to help keep impeller 28 aligned within fluid chamber 34 and aids in the fracturing of the water or other fluid.

Tasks 235 and 236 of subprocess 230 form raised substantially circular planar surface 102 and grooves 106 as discussed hereinbefore. Since frustal portion 126 has minor diameter 130 at impeller inlet end 90, i.e., tapers towards inlet end 90, chamfer 112 (FIGS. 9 and 10) is not needed on frustal impeller 84.

Those skilled in the art will appreciate that, depending upon the material of which impeller 28 is fabricated, subprocess 230 may involve molding, machining, or otherwise producing the features formed by tasks 231, 232, 233, 234, 235, 236, and/or 237 using established techniques. It will also be appreciated that the order of tasks 231, 232, 233, 234, 235, 236, and/or 237 within subprocess 230 is irrelevant to this discussion. For example, tasks 231, 232, 233, 234, 235, 236, and 237 may be performed substantially simultaneously if subprocess 230 fabricates impeller 28 by molding. Impeller 28 is a non-metallic impeller. That is, impeller 28 is fabricated of a material other than metal. Desirably, impeller 28 is fabricated of a stable material that is substantially non-reactive to air or water (or other fluid to be atomized by atomizing nozzle 20). By being substantially non-reactive, the useful lifetime of atomizing nozzle 20 is maximized. A typical material for the fabrication of impeller 28 is polycarbonate. Other plastics and resins may also be used.

Those skilled in the art will appreciate that the order in which subprocesses 210, 220, and 230 are performed, i.e., the order in which nozzle body 24, orifice insert 26, and impeller 28 are fabricated, is irrelevant. Changing the order from that exemplified in this discussion does not depart from the spirit of the present invention.

The following discussion refers to FIG. 3.

Fluid chamber 34 is formed of insert chamber 66 and body chamber 42. Impeller 28 is configured to reside within fluid chamber 34. In order to fulfill its function, impeller 28 needs to be able to spin, vibrate, and otherwise move within fluid chamber 34. Therefore, fluid chamber 34 should have a diameter greater than impeller diameter 88 and a length greater than impeller length 86.

Insert chamber 66 has insert-chamber diameter 68. Body chamber 42 has body-chamber diameter 44. Body-chamber diameter 44 is substantially equal to or less than insert-chamber diameter 68.

Fluid chamber 34 is formed of insert chamber 66 and body chamber 42 together. Insert chamber 66 has insert-chamber length 70 and body chamber 42 has body-chamber length 46. Therefore, fluid chamber 34 has a length 134 that is the sum of insert-chamber length 70 and body-chamber length 46.

Impeller 28 must be free to move inside fluid chamber 34. Therefore, impeller diameter 88 is less than either body-chamber diameter 44 or insert-chamber diameter 68. Similarly, impeller length 86 is less than fluid-chamber length 134.

Fluid chamber 34 is bound on one end by outlet channel 72 and on the other end by inlet channel 48. Since it is desirable that impeller 28 be retained within fluid chamber 34, impeller diameter 88 is greater than either outlet-channel diameter 74 or inlet-channel diameter 50.

Figure 12:
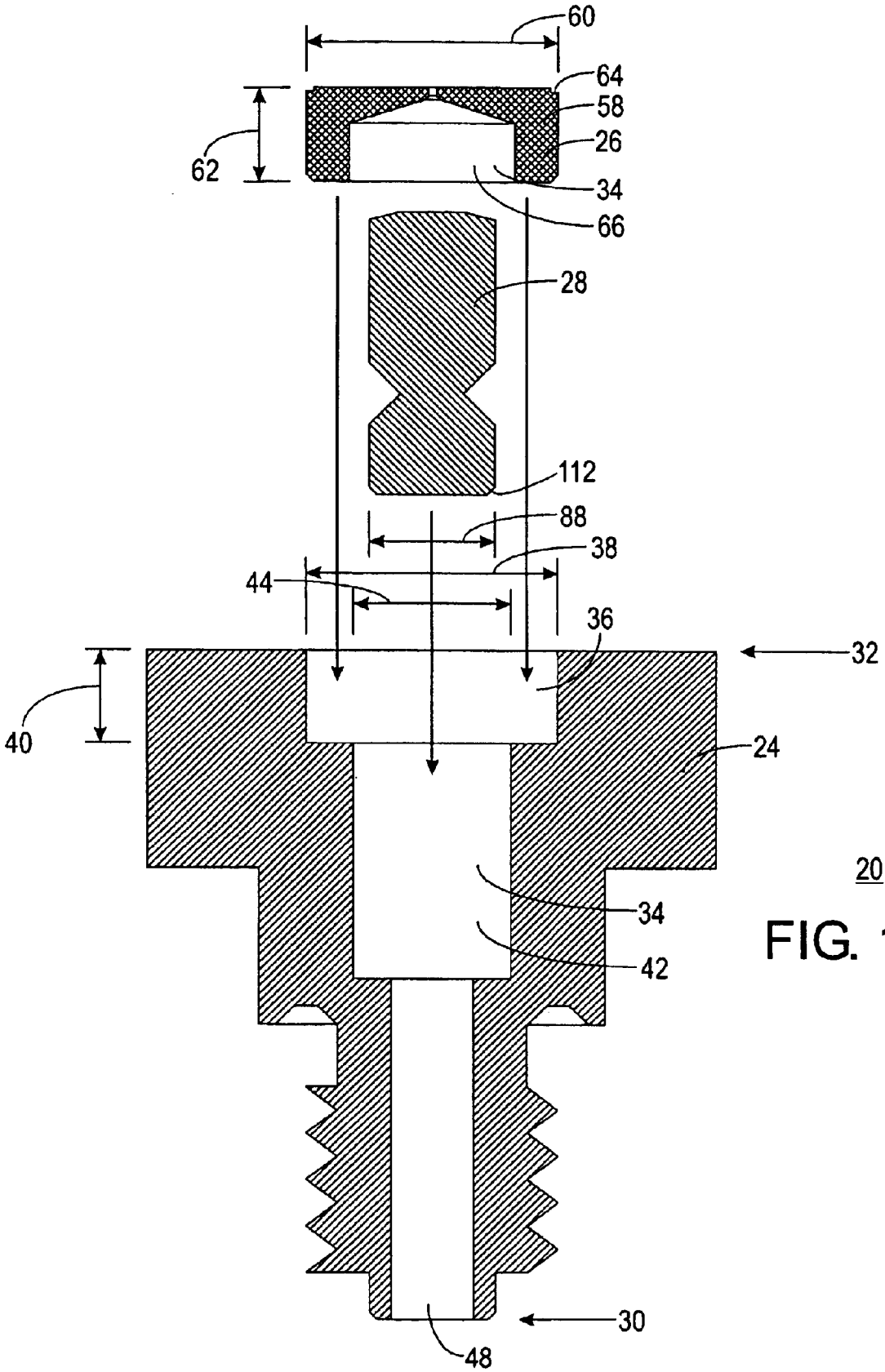
FIG. 12 shows an exploded cross-sectional front view taken at line 3—3 of FIG. 2 of the atomizing nozzle of FIG. 1 in accordance with a preferred embodiment of the present invention.
Figure 13:
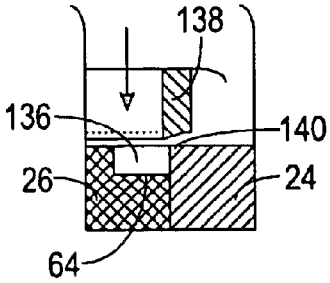
FIG. 13 shows a cross-sectional front view taken at line 3—3 of FIG. 2 of a portion encompassed by line 13—13 of FIG. 3 of the atomizing nozzle of FIG. 1 during insertion of the orifice insert into the nozzle body in accordance with a preferred embodiment of the present invention.
Figure 14:
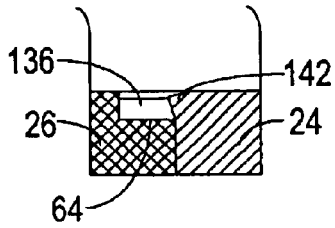
FIG. 14 shows a cross-sectional front view taken at line 3—3 of FIG. 2 of a portion encompassed by line 13—13 of FIG. 3 of the atomizing nozzle of FIG. 1 after insertion of the orifice insert into the nozzle body in accordance with a preferred embodiment of the present invention.

FIG. 12 shows a cross-sectional front view taken at line 3—3 of FIG. 2 of atomizing nozzle 20 prior to insertion of orifice insert 26 into nozzle body 24, and FIGS. 13 and 14 show a magnified portion of atomizing nozzle 20 encompassed by line 13—13 of FIG. 3 during and (FIG. 13) after (FIG. 14) insertion of orifice insert 26 into nozzle body 24 in accordance with a preferred embodiment of the present invention. The following discussion refers to FIGS. 1, 2, 3, 4, 12, 13, and 14.

With the completion of subprocesses 210, 220 and 230, the principal components of atomizing nozzle 20 are ready for assembly. In a task 240 of process 200, inlet end 90 of impeller 28 is inserted into body chamber 42 through insert recess 36. If impeller 28 is either cylindrical impeller 80 (FIG. 9) or waisted impeller 82 (FIG. 10), then chamfer 112 guides impeller 28 into body chamber 42. If impeller 28 is frustal impeller 84 (FIG. 11), then the shape of frustal portion 126 guides impeller 28 into body chamber 42.

Since impeller diameter 88 is greater than inlet channel diameter 50, impeller 28 is inhibited from entering inlet channel 48 and remains in body chamber 42.

In a task 250 of process 200, orifice insert 26 is affixed to nozzle body 24. In the preferred embodiment of the Figures, nozzle body 24 is fabricated of brass and orifice insert 26 is fabricated of stainless steel. It will be appreciated, however, that these materials are not a requirement of the present invention and other materials may be used.

Orifice insert 26 is inserted into insert recess 36 or nozzle body 24. Desirably, orifice insert 26 and insert recess 36 are dimensioned so that insert diameter 60 is substantially equal to recess diameter 38. This allows orifice insert 26 to be press fit into insert recess 36 in a manner well known to those skilled in the art. Desirably, insert length 62 is substantially equal to recess length 40, thereby allowing orifice insert 26 to substantially flush-fill insert recess 36.

As discussed hereinbefore insert-chamber diameter 68 is desirably greater than or equal to body chamber diameter 44. This inhibits impeller 28 from catching upon orifice insert 26 during insertion or operation.

Desirably, insert 26 is affixed to nozzle body 24 by friction, due to a press fit, in conjunction with crimping or riveting. Preferably, insert shoulder 64 forms a mounting groove 136 around the periphery of insert 26 (FIG. 13). A crimping or riveting tool 138 is then used to distort an edge 140 of insert recess 36. Distorted edge 142 (FIG. 14) then entraps orifice insert 26 inside of insert recess 36.

Those skilled in the art will appreciate that other methods of affixing orifice insert 26 to or into nozzle body 24 may be used without departing from the spirit of the present invention.

In a final task 260, O-ring 22 is added to atomizing nozzle 20. O-ring 22, in conjunction with O-ring seat 54, allows atomizing nozzle 20 to make a watertight connection with a pipe (not shown) of the misting system (not shown).

Those skilled in the art will appreciate that the method of assembling atomizing nozzle 20 described hereinbefore is exemplary only, and that a plurality of other, equally valid methods may be used. The use of another method of assembly does not depart from the spirit of the present invention.

Figure 15:
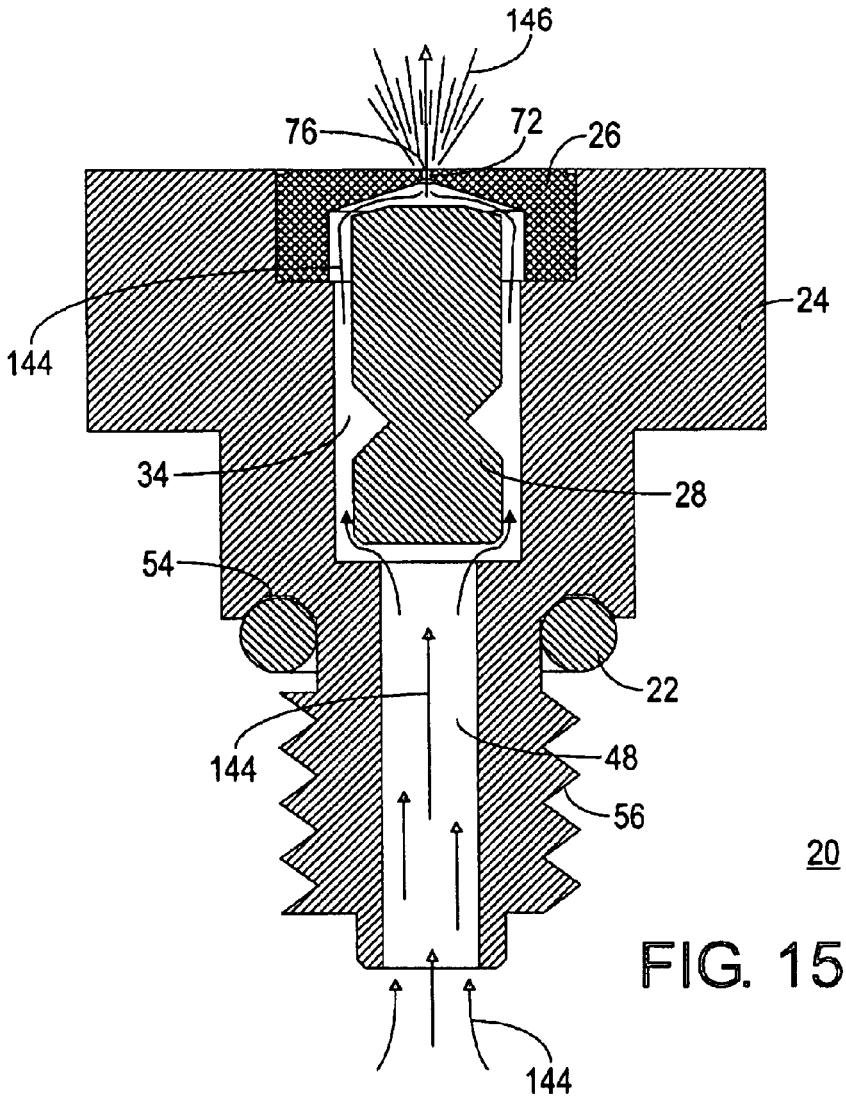
FIG. 15 shows a cross-sectional front view taken at line 3—3 of FIG. 2 of the atomizing nozzle of FIG. 1 during operation in accordance with a preferred embodiment of the present invention.

FIG. 15 shows a cross-sectional front view taken at line 3—3 of FIG. 2 of atomizing nozzle 20 during operation in accordance with a preferred embodiment of the present invention. The following discussion refers to FIG. 15.

When atomizing nozzle 20 is connected to a pipe (not shown) of a misting system (not shown) and pressure is applied, water 144 (or other fluid) is forced into fluid inlet channel 48. From fluid inlet channel 48, water 144 enters fluid chamber 34. In fluid chamber 34, water 144 flows around impeller 28, imparting spinning, vibrating, and other motions to impeller 28. The motions of impeller 28 cause water 144 to fracture, i.e., produces cavitation of water 144. Fractured water 144 flows from fluid chamber 34 into outlet channel 72. Water 144 then exits outlet channel 72 via orifice 76 as a fine mist or fog 146.

In summary, the present invention teaches an improved atomizing nozzle 20 and a process 200 for the manufacture of atomizing nozzle 20. Atomizing nozzle 20 is provided having a metallic orifice insert 26 and a non-metallic impeller 28. Atomizing nozzle 20 is fabricated of materials to resist the rapid build-up of residual mineral materials contained in the water 144 or other fluid.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An atomizing nozzle for use in a misting system, said atomizing nozzle comprising:

a nozzle body having a nozzle inlet end, having a nozzle outlet end, and encompassing a fluid chamber between said nozzle inlet end and said nozzle outlet end;

a metallic orifice insert affixed to said nozzle body proximate said nozzle outlet end; and a non-metallic impeller configured to reside within said fluid chamber between said metallic or if ice insert and said nozzle inlet end.

2. An atomizing nozzle as claimed in claim 1 wherein said non-metallic impeller is formed of a plastic.

3. An atomizing nozzle as claimed in claim 2 wherein said plastic is polycarbonate.

4. An atomizing nozzle as claimed in claim 1 wherein said non-metallic impeller is one of:

a cylindrical impeller;

a waisted impeller; and a frustal impeller.

5. An atomizing nozzle for use in a misting system, said atomizing nozzle comprising:

a nozzle body having a nozzle inlet end, having a nozzle outlet end, and encompassing a fluid chamber between said nozzle inlet end and said nozzle outlet end;

a metallic orifice insert affixed to said nozzle body proximate said nozzle outlet end; and a non-metallic impeller configured to reside within said fluid chamber between said metallic orifice insert and said nozzle inlet end, wherein said non-metallic impeller comprises:

an impeller length;

an impeller diameter substantially perpendicular to said impeller length;

an impeller inlet end;

an impeller outlet end, wherein said impeller inlet end is closer to said nozzle inlet end than said nozzle outlet end when said non-metallic impeller resides within said fluid chamber;

a planar surface at said impeller outlet end, wherein said planar surface is substantially circular, has a surface circumference, and has a surface diameter less than said impeller diameter; and a plurality of grooves at said impeller outlet end, where each of said grooves has an outer edge substantially tangential to said surface circumference.

6. An atomizing nozzle for use in a misting system, said atomizing nozzle comprising:

a nozzle body having a nozzle inlet end, having a nozzle outlet end, and encompassing a fluid chamber between said nozzle inlet end and said nozzle outlet end, wherein said fluid chamber comprises:

a first chamber configured substantially as a right cylinder, having a first chamber diameter, and having a first chamber length; and a second chamber configured substantially as a right cylinder, having a second chamber diameter greater than or equal to said first chamber diameter, and having a second chamber length;

a metallic orifice insert affixed to said nozzle body proximate said nozzle outlet end; and a non-metallic impeller configured to reside within said fluid chamber between said metallic orifice insert and said nozzle inlet end.

7. An atomizing nozzle as claimed in claim 6 wherein:

said atomizing nozzle additionally comprises:

an inlet channel having an inlet channel diameter; and an outlet channel having an outlet channel diameter; and said non-metallic impeller has an impeller diameter and has an impeller length, wherein;

said impeller diameter is greater than said inlet channel diameter;

said impeller diameter is greater than said outlet channel diameter;

said impeller diameter is less than said first chamber diameter;

said impeller length is less than a sum of said first and second chamber lengths.

8. A method of manufacturing an atomizing nozzle for use in a misting system, said method comprising:

a) fabricating a nozzle body encompassing a first chamber;

b) fabricating a metallic orifice insert encompassing a second chamber;

c) fabricating a non-metallic impeller;

d) inserting said non-metallic impeller into said first chamber; and e) affixing said metallic orifice insert into said nozzle body.

9. A method as claimed in claim 8 wherein:

said fabricating activity a) comprises forming an insert recess within said nozzle body; and said affixing activity e) affixes said metallic orifice insert within said insert recess.

10. A method as claimed in claim 8 wherein:

said fabricating activity c) fabricates said non-metallic impeller of a plastic.

11. A method as claimed in claim 8 wherein said fabricating activity b) fabricates said metallic orifice insert having said second chamber in the form of a right cylinder.

12. A method of manufacturing an atomizing nozzle for use in a misting system, said method comprising:

fabricating a nozzle body encompassing a first chamber, said fabricating activity comprises:

forming said first chamber first within said nozzle body, wherein said first chamber is substantially cylindrical and has a first-chamber diameter; and forming an inlet channel within said nozzle body, wherein said inlet channel is substantially cylindrical and has an inlet-channel diameter less than said first chamber diameter, and wherein said first chamber and said inlet channel are contiguous and substantially coaxial;

fabricating a metallic orifice insert encompassing a second chamber;

fabricating a non-metallic impeller;

inserting said non-metallic impeller into said first chamber; and affixing said metallic orifice insert into said nozzle body.

13. A method as claimed in claim 12 wherein said non-metallic impeller has an impeller diameter less than said first-chamber diameter and greater than said inlet-channel diameter.

14. A method of manufacturing an atomizing nozzle for use in a misting system, said method comprising:

fabricating a nozzle body encompassing a first chamber;

fabricating a metallic orifice insert encompassing a second chamber;

fabricating a non-metallic impeller;

inserting said non-metallic impeller into said first chamber; and affixing said metallic orifice insert into said nozzle body by one of crimping and riveting.

15. A method of manufacturing an atomizing nozzle for use in a misting system, said method comprising:

a) fabricating a nozzle body encompassing a first chamber;

b) fabricating a metallic orifice insert encompassing a second chamber;

c) fabricating a non-metallic impeller, wherein said fabricating activity c) comprises:

forming a portion of said non-metallic impeller as substantially a cylinder having an impeller diameter;

forming a raised planar surface at a first end of said portion of said non-metallic impeller, wherein said raised planar surface is substantially circular, has a surface circumference, and has a surface diameter less than said impeller diameter; and forming a plurality of grooves at said first end of said portion of said non-metallic impeller, wherein each of said grooves has an outer edge substantially tangential to said surface circumference;

d) inserting said non-metallic impeller into said first chamber; and e) affixing said metallic orifice insert into said nozzle body.

16. A method as claimed in claim 15 wherein said fabricating activity c) additionally comprises forming a knurl upon an outer surface of said portion of said non-metallic impeller.

17. A method as claimed in claim 15 wherein said non-metallic impeller is one of a cylindrical impeller and a waisted impeller, and wherein said fabricating activity c) additionally comprises forming a chamfer at a second end of said portion of said non-metallic impeller.

18. A method as claimed in claim 17 wherein said non-metallic impeller is said waisted impeller, and wherein said fabricating activity c) additionally comprises forming a waist within said portion of said non-metallic impeller.

19. A method as claimed in claim 15 wherein said non-metallic impeller is a frustal impeller, wherein said portion of said non-metallic impeller is a first portion of said non-metallic impeller, and wherein said fabricating activity c) additionally comprises forming a second portion of said non-metallic impeller as substantially a frustum contiguous with said first portion of said non-metallic impeller.

20. An atomizing nozzle for use in a misting system, said atomizing nozzle comprising:

a nozzle body having an inlet end, having an outlet end, having an insert recess proximate said outlet end, and encompassing a first portion of a fluid chamber;

a metallic orifice insert affixed to said nozzle body within said insert recess and encompassing a second portion of said fluid chamber; and a non-metallic impeller configured to reside within said fluid chamber between said metallic orifice insert and said nozzel inlet end.

* * * * *

UNITED STATES PATENT AND TRADEMARK OFFICE

CERTIFICATE OF CORRECTION

PATENT NO. : 6,863,230 B2
DATED : March 8, 2005
INVENTOR(S) : Palestrant, Nathan It is certified that error appears in the above-identified patent and that said Letters Patent is hereby corrected as shown below:

Column 9,
Line 39, "or if ice" should read -- orifice --.

Signed and Sealed this

Seventeenth Day of May, 2005

JON W. DUDAS
*Director of the United States Patent and Trademark Office*